US006763963B1

(12) United States Patent
Martin

(10) Patent No.: US 6,763,963 B1
(45) Date of Patent: Jul. 20, 2004

(54) REMOVABLE CASE AND METHOD FOR OPENING AND CLOSING A PRESSURIZED CAN PROVIDED WITH A FRANGIBLE OBTURATOR

(75) Inventor: Didier Martin, Cran-Gevrier (FR)

(73) Assignee: Akline, Chavanod (FR)

( * ) Notice: Subject to any disclaimer, the term of this patent is extended or adjusted under 35 U.S.C. 154(b) by 0 days.

(21) Appl. No.: 09/719,833

(22) PCT Filed: Jun. 17, 1998

(86) PCT No.: PCT/FR98/01271

§ 371 (c)(1),
(2), (4) Date: Dec. 18, 2000

(87) PCT Pub. No.: WO99/65780

PCT Pub. Date: Dec. 23, 1999

(51) Int. Cl.[7] ..... B65D 51/18

(52) U.S. Cl. ..... 220/254.2; 220/254.1; 220/254.3; 220/254.7; 220/258.1; 220/258.3; 220/259.1; 220/278; 220/212; 220/906; 81/31.5

(58) Field of Search ..... 220/811, 817, 220/818, 906, 269–270, 277, 278, 256.1, 258.1, 258.3, 258.4, 258.5, 259.1, 284, 212, 272, 273, 254.1–254.9; 81/3.15

(56) References Cited

U.S. PATENT DOCUMENTS

| | | | | | |
|---|---|---|---|---|---|
| 2,942,752 | A | | 6/1960 | Brunel | |
| 4,077,538 | A | | 3/1978 | Waterbury | |
| 4,433,792 | A | * | 2/1984 | Mandel | 220/269 |
| 4,442,950 | A | * | 4/1984 | Wilson | 220/269 |
| 4,463,866 | A | | 8/1984 | Mandel | |
| 4,673,099 | A | * | 6/1987 | Wells | 220/258.5 |
| 4,681,238 | A | * | 7/1987 | Sanchez | 220/260 |
| 4,720,022 | A | * | 1/1988 | Gomes | 220/269 |
| 4,951,835 | A | * | 8/1990 | DeMars et al. | 220/269 |
| 5,080,249 | A | * | 1/1992 | Shock | 220/258.2 |
| 5,573,133 | A | * | 11/1996 | Park | 220/906 |
| 5,655,678 | A | * | 8/1997 | Kobayashi | 220/269 |
| 5,813,559 | A | * | 9/1998 | Cho | 220/258.2 |
| 5,911,794 | A | * | 6/1999 | Nordhoff | 220/713 |
| 6,059,137 | A | * | 5/2000 | Westwood et al. | 220/258.2 |
| 6,098,830 | A | * | 8/2000 | Jamieson | 220/258.2 |
| 6,347,720 | B1 | * | 2/2002 | Schley | 220/258.2 |

FOREIGN PATENT DOCUMENTS

| | | | | |
|---|---|---|---|---|
| DE | 4335709 A1 | * | 3/1994 | 220/270 |
| EP | 0 558 422 | | 9/1993 | |
| FR | 2 763 315 | | 11/1998 | |

* cited by examiner

*Primary Examiner*—Robin A. Hylton
(74) *Attorney, Agent, or Firm*—Young & Thompson

(57) ABSTRACT

A method and device for opening a drink can provided with a frangible obturator which can be pushed back inside the can using a tongue that is fixed in a horizontal position in the middle of the lid by means of a rivet on which the tongue can pivot as a lever to produce an opening which is later closed by a movable case that is adapted on the tongue which is pivoted around the river in order to move onto the opening.

8 Claims, 5 Drawing Sheets

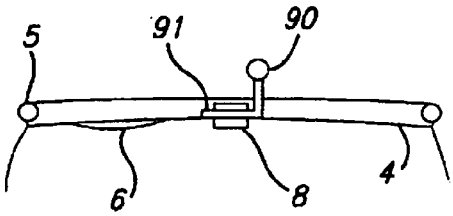
FIG. 3A1
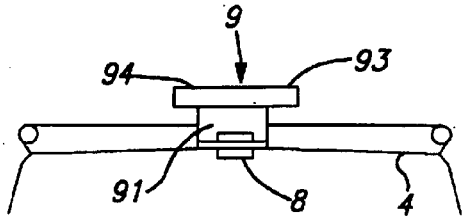
FIG. 3A2
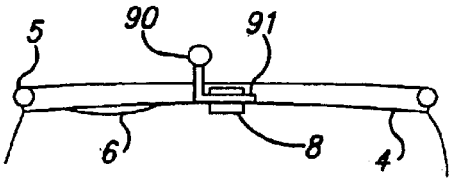
FIG. 3B1
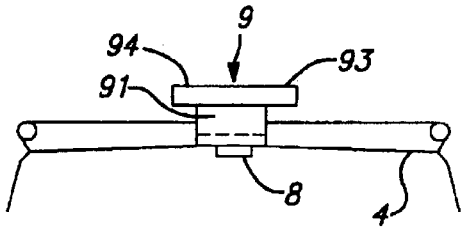
FIG. 3B2
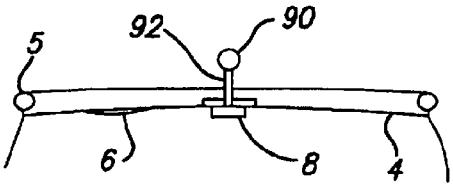
FIG. 3C1
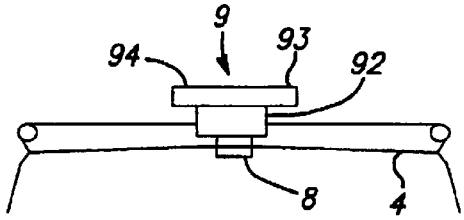
FIG. 3C2
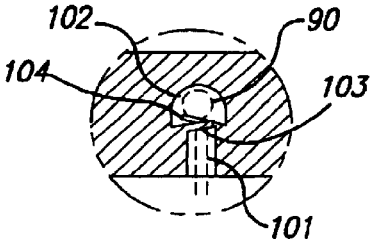
FIG. 4C
FIG. 4A
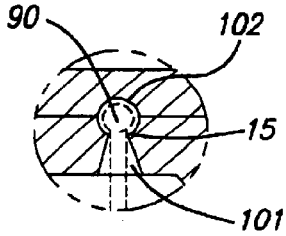
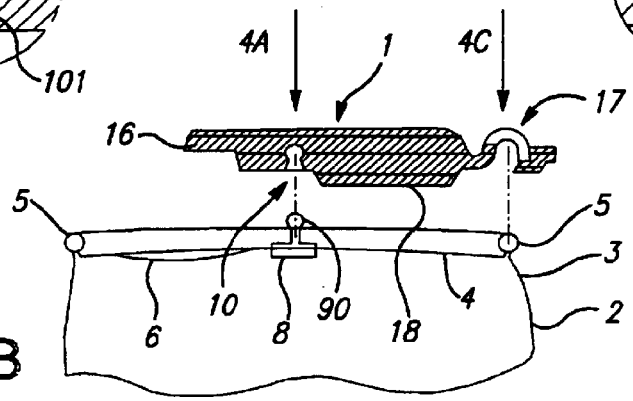
FIG. 4B

REMOVABLE CASE AND METHOD FOR OPENING AND CLOSING A PRESSURIZED CAN PROVIDED WITH A FRANGIBLE OBTURATOR

BACKGROUND OF THE INVENTION

The invention relates to a method for opening the frangible obturator of a container of the drink can type according to the preamble of the first claim, using an handling device or handler subsequently reusable for closing said drink can. The method is of particular interest in that it provides numerous advantages in the manufacturing and filling of drink cans, as well as in their handling, storage and distribution.

In the prior art, some devices for closing such containers are already known, comprising a cylindrical body, a bottom and a lid on which an aperture may be provided with a globally sectoral size smaller than the lid size, using a frangible obturator that is pushed inside the container through the leverage provided by the tear-off tab maintained in the middle and above said lid by a rivet.

Among these prior art devices, the one described in the European Patent EP-0 558 422 is without doubt the most remarkable one in that it comprises a case removably assembled on or around the tear-off tab, before or after opening a metallic cylindrical can including a lid with a frangible obturator so as to form a movable tab pivoting around the rivet enabling the tear-off tab to be handled on the upper part of the lid, wherein this case will on the one hand fit onto said tear-off tab, and on the other hand, due to adequately shaped external peripheral edges, clip around the peripheral lid crimping rim on the cylindrical can body, this rim then serving as an external rail for facilitating the case's circular displacements above the lid.

An important advantage of this device is that the removable case may be positioned on the can after the filling and the crimping of the lid, which was an important advance as compared with prior solutions.

In order to provide the consumer with a drink can equipped with its closing case, right from the start, a fitting operation was therefore required before the product's sales distribution; this fitting operation consisted of three main phases:

- lifting the pull-tab without tearing the frangible obturator,
- propelling the removable case for fitting it on and around said tab,
- clipping by vertically pressing the case onto the crimping rim.

This fitting operation, technologically feasible and economically affordable, does however meet with a first series of drawbacks: it requires carrousel or comb type fitting robots that must operate at a very high rate with a good deal of precision for lifting the metal tab in a first phase, without thereby piercing the frangible obturator; on the other hand, the fitting robots must be installed in the filling premises of the drink manufacturer, furthermore, placing the case on the lid of the can creates excessive thickness on the peripheral rim that may hinder transport and storage of such cans traditionally stacked one upon the other.

SUMMARY OF THE INVENTION

To overcome these drawbacks, in accordance with the invention, a method is provided for opening and closing a drink can type container consisting of a usually metallic cylindrical body on which is crimped, through a peripheral crimping rim, a lid devoid of any tear-off tab or pull-tab but provided with a frangible obturator that may be torn apart along a line of least resistance implemented for that purpose in order to provide a partial aperture by using a handling instrument, also called a case, that is fitted in, removably, through a capture shaft which works together with a linking joint fixed by a rivet to the center of said lid so as to allow the case to both pivot in the vertical plane by lifting its end close to the peripheral crimping rim around said joint, to act as a lever and push in the frangible obturator, by means of the other end provided with a reinforced leading edge for that purpose, and further move in the horizontal plane around the same joint so as to close the aperture by being clipped on the peripheral crimping rim.

For better comparison with the aforementioned closest prior art devices, i.e. European Patent EP-0 558 422, the preferred term case will systematically be used for designating the handling instrument or handler according to the invention and this, for all the text that follows.

According to a first alternative of the method just described, the case that is used for opening and closing drink cans, is positioned on the lid in a very simple manner; the case is indeed fitted onto the linking joint by mere vertical pressure, wherein said joint is itself shaped to be accommodated in a capture shaft located in the bulk of the case so that the leading edge at the front of said case will be normal to the frangible obturator and the rear portion of this case will be normal to the crimping rim, so as to form firstly the tab element for pushing in the frangible obturator, and if required, secondly the closing element by horizontally pivoting the case around the rivet over a 180° angle sector.

It will be well understood that such an alternative provides undeniable advantages over the prior art in that the automatic fitting of the case is thereby considerably facilitated as it is no longer required to lift up the tab; mere vertical pressure is enough to bring the case onto the can and to clip it on the linking joint and the crimping rim, simultaneously.

However, as such a method results in positioning a case on the crimping rim right from the start, according to another particularly sophisticated alternative of the invention, it is envisaged to join the case to the lid in two steps: first, by vertically pressing the case onto the linking joint that will fit into a capture shaft provided in the bulk of the case, then by a radial translation in a plane substantially horizontal in parallel to the lid bringing the leading edge of the case normal to the frangible obturator and the rear portion of the case close to the peripheral rim, so as to form firstly, here again, the tab element for pushing in the frangible obturator, and if required, secondly the closing element by horizontally pivoting the case by 180° around the rivet.

According to the latter alternative, new advantages appear that are here related to the fact that the case, which may be translated radially on the lid, may lie entirely in the interior space defined by the crimping rim and the lid face.

It is then understood that the thereby positioned case is no longer an obstacle for the lid crimping tool with the lucky consequence that it may be assembled on the lid before crimping.

Moreover, such a method simplifies the fitting of the case and eliminates some fitting robots on the filling lines which furthermore avoids disturbing the process; the method also allows to make substantial savings of metal due to the partial elimination of the prior art tear-off tabs and save part of the folding operations related to this same tab. Finally, such a method, that avoids excessive plastic thicknesses on the peripheral rim, with the case being temporarily maintained in the middle of the lid, is particularly advantageous for transport and storage of the drink cans that will be done as usual.

BRIEF DESCRIPTION OF THE DRAWINGS

Hereafter, two main alternatives of the device implementing the method according to the invention will be described, provided by way of non-limiting examples of the invention to better highlight further advantages and features with reference to the drawings wherein:

FIGS. 3*a*1–*c*2 illustrate three different alternatives of the linking joint between the case of FIGS. 1 and 2, and the lid of the can;

FIGS. 4*a–c* are vertical sectional views schematically illustrating the assembly of a case in accordance with the first simplified alternative of the method, on a schematically and partially represented can, and showing in cut-out views at a larger scale the detail of two embodiments for snapping the linking joint into the bulk of the case;

FIG. 9 schematically shows the case in the position where it is clipped onto the peripheral rim after opening the frangible obturator, illustrated in FIG. 8; FIG. 10 illustrates the case of FIG. 9 after rotation by 180° so that it will overlap the aperture detailed in FIGS. 8 and 9.

DESCRIPTION OF THE PREFERRED EMBODIMENTS

Figure 1:
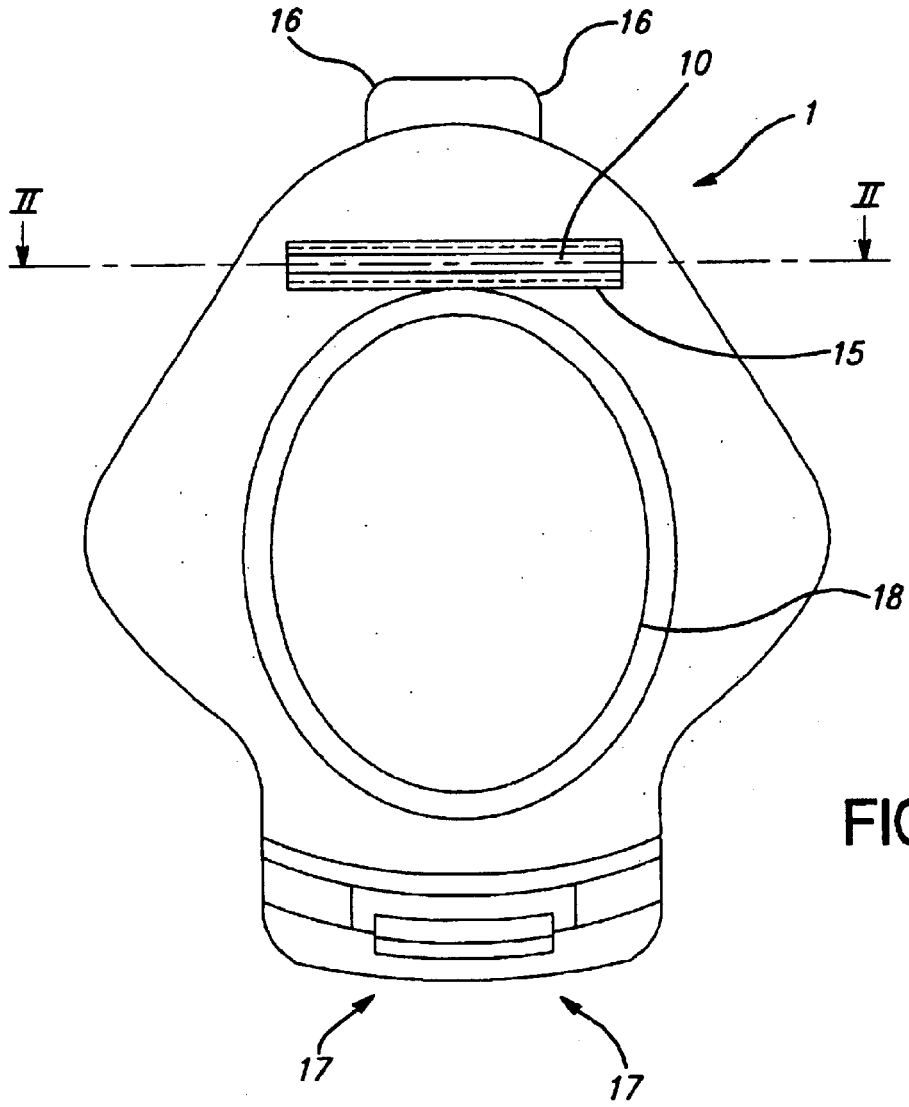
FIG. 1 illustrates a first embodiment of the removable case.

Referring to the figures, two preferred alternatives of the removable case 1 implementing the method as set forth above, for opening and subsequent closing of containers 2 of the drink can type will be described hereafter.

Such containers generally include a cylindrical body usually obtained by drawing a soft steel or aluminum flat blank, a necking 3 being made later on near the upper edge of said body onto which an equally metallic lid 4 is attached by perimetric crimping creating a particularly advantageous peripheral rim 5 as will be stated later; the lid 4 is provided with a frangible obturator 6, in a known manner, which when it has been torn along a line of least resistance made for this purpose, provides an aperture 7 of a globally sectoral shape, allowing the drink contained in the can 2 to be consumed. The cutting out of the obturator 6 is generally performed in the prior art by means of a tear-off tab normally comprising an eyelet grip, manufactured from thin sheet metal through adequate folding. This tear-off tab is firmly secured to the can 2 by means of a rivet 8 in the middle and above the lid 4 so that when said tab is lifted it expels the obturator 6 towards the inside of the container through leverage on the rivet 8, before returning naturally to a position slightly inclined with regard to its initial position.

Figure 2:
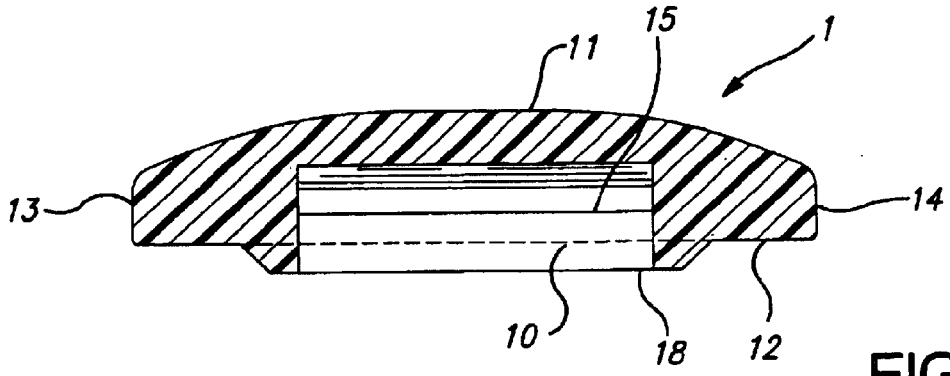
FIG. 2 corresponds to section II—II of FIG. 1.

Referring to FIG. 3 of the drawings, and in accordance with one of the essential features of the invention, the tear-off tab used in prior solutions is omitted and replaced by a removable case 1 as illustrated in the embodiments of FIGS. 1 and 2.

Instead of the tear-off tab, a linking joint 9 is provided that is maintained in the middle of the lid 4 by a rivet 8. This linking joint 9 essentially includes a horizontal axis 90 maintained in a horizontal position a little above the upper face of lid 4 by a bendable link piece firmly securing axis 90 to lid 4.

Axis 90 is such that it is able to cooperate with case 1 provided with a capture shaft for that purpose, inside which axis 90 will clip or fit to firmly secure case 1 to lid 4, as will be described later.

In accordance with particular embodiments illustrated in FIG. 3, axis 90 may be assembled on a bendable linking part 91, e.g. from the same metal as the lid, as illustrated in FIG. 3*a*1, i.e. on the side opposite to the frangible obturator 6 with regard to the rivet 8 or vice-versa on the same side as illustrated in FIG. 3*b*1, or else may be made directly from the rivet 8 using a vertical prominence 92 as illustrated in FIG. 3*c*1; the linking joint 9 comprises a bendable element, advantageously of a metal similar to that of lid 4, with a general L shape, the rectangular vertical branch 91 of which horizontally supports axis 90 at its longitudinal edge, the length of which is shorter than that of axis 90 so as to create on both sides of branch 91 projecting axis portions 93 and 94; the horizontal branch of the element is for firmly securing the linking joint 9 to lid 4 by means of a rivet 8 from which it is made (FIGS. 3*c*1–2) or that crosses it (FIGS. 3*a*1–2 and 3*b*1–2) allowing the centered joint to rotate on rivet 8.

Naturally, one or the other of these embodiments or their equivalents will be preferred depending on the manufacturing criteria in the general economy of the inventive device.

According to a first alternative implementing the method according to the invention, and referring to FIGS. 1 and 2, and to FIGS. 4*a–c*, case 1 in the general shape of an angular sector (without this shape being actually mandatory) is obtained preferably by injecting some plastic material or metal inside a mould provided for mass production with high throughput. Each case 1 includes an upper side 11 and a lower side 12 for resting on lid 4, both sides being brought together by substantially vertical side walls 13 and 14 capable of forming together a volume for receiving additional joints able to cooperate closely with axis 90 and its link to lid 4, so as to form a device allowing the frangible obturator 6 to be opened and subsequently closed.

For that purpose, and in accordance with this first low cost alternative of case 1, a capture shaft 10 is provided from the lower side 12 of the case 1, so as to extend vertically into the bulk of the case, symmetrically on both sides of its longitudinal plane of symmetry, forming a longitudinal container with an axis perpendicular to the longitudinal axis of symmetry of case 1 substantially coinciding with a radius of lid 4; such a shaft 10 is able to receive freely but with minimum play, the axis 90 that may thus fit gradually into it as case 1 approaches the lid surface 4 through a vertical translation movement as illustrated by the arrow A in FIG. 4*b*.

In accordance with the drawings, especially with FIGS. 4*a–b*, the capture shaft 10 according to a first embodiment has an entrance area 101 whose vertical section in the longitudinal plane of symmetry is advantageously triangular, flared towards the bottom and narrowing vertically up to a necking 15 topped by a cavity 10 of circular section, capable of receiving axis 90 of linking joint 9 when the case is in contact with the lid; obviously, the aperture area of necking 15 is smaller than the diameter of axis 90 so as to retain it inside cavity 102, after a forced passage into the necking at the time of clipping.

According to another embodiment detailed by the view of FIG. 4*c*, shaft 10 has an entrance area 101 with vertical walls that are parallel or advantageously inclined from bottom to top; at the line where axis 90 is attached onto its linking part 91, 92 each wall is provided with at least one flexible tab 103, 104 extending substantially horizontally towards the other wall where it may, if required, rest vertically after having been stressed from bottom to top by axis 90 upon penetrating into cavity 102, during assembly; the tabs 103 and 104 are dimensioned so as to reach the line where axis 90 is attached to its base, and/or under the protruding portions 93, 94 of axis 90 and resting on the facing wall, forming so many vertically retaining elements of axis 90 inside the bulk of case 1.

In accordance with this first alternative, case 1 furthermore includes at one of its ends an appendix 16 forming a reinforced leading edge so as to act, as will be explained below, on the frangible obturator 6 that tears apart along a line of least resistance, in order to provide a definitive aperture 7. At the other end of case 1, means for linking the case to the crimping rim 5 are provided; such means are for instance described in the already mentioned European Patent EP 0 558 422. It will also be noted that these linking means 17 notably allow the crimping rim 5 of lid 4 on can 2 to be used as a rail for circularly guiding case 1 when it is used for closing the aperture 7 obtained by rotating said case 1 around rivet 8, bringing its lower side 12 normal to aperture 7 for closing it; advantageously, lower side 12 of case 1 has a bulge 18, the shape of which is substantially the same as the general shape of aperture 7 and the thickness is sufficient for fitting in snugly therein and improving the closure; obviously and as set forth in the European Patent, the linking means 17 cooperating with the crimping rim 5 will complete the compression of the bulge area 18 inside aperture 7.

It should be noted that the entrance of the capture shaft 10 is positioned on the lower side 12 of the case at a distance from the end comprising the linking means 17 so that when it is on the rim 5, joint 9 fits exactly into shaft 10.

Thus formed, this first alternative embodiment for case 1 first of all provides the function of opening the drink can, e.g. delivered with case 1 mounted thereon, after the filling and crimping the lid 4 on can 2; the user then has to clear the linking means 17 from rim 5 so as to drive case 1 into vertical rotation around the linking joint 9 firmly secured to the middle of lid 4 by means of rivet 8. In this vertical rotational motion, the reinforced edge 16 rests on the frangible obturator 6 that it pushes in through leverage joint on 9. Once the obturator 6 has been pushed inside can 2, all that has to be done is to tilt back case 1 in a reverse rotation for clipping, along arrow B of FIG. 4*b*, the case 1 on rim 5 by means of its linking joints 17, with case 1 then being in a position to be used for another closure when the liquid contained inside can 2 has been consumed; for that purpose, all you have to do is perform a rotation by 180° along rim 5 that serves as a circular guide for bringing the bulge area 18 normal to aperture 7 and forming a relatively efficient closure as explained previously.

Figure 1A:
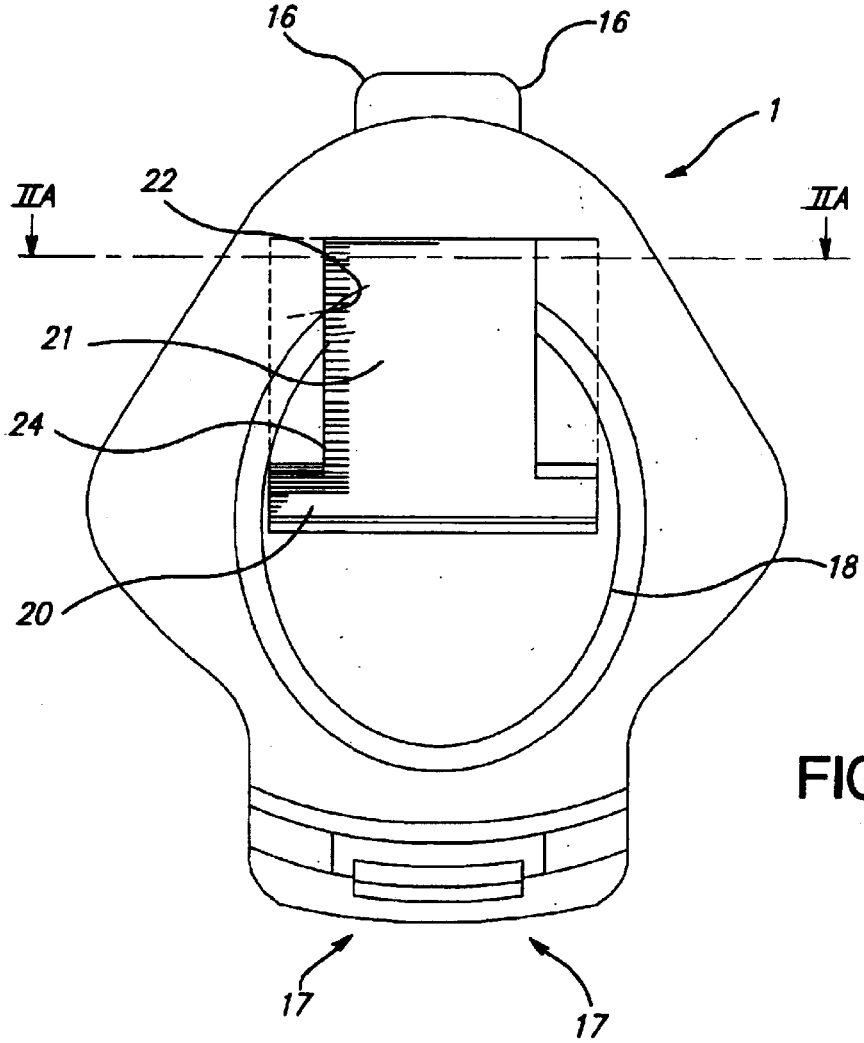
FIGS. 1*a* and 2*a* illustrate a second embodiment of the removable case in plan and section views.
Figure 2A:
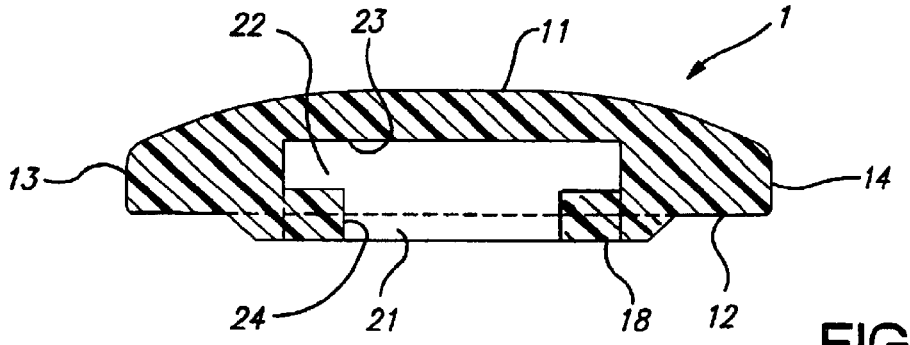
Figure 10:
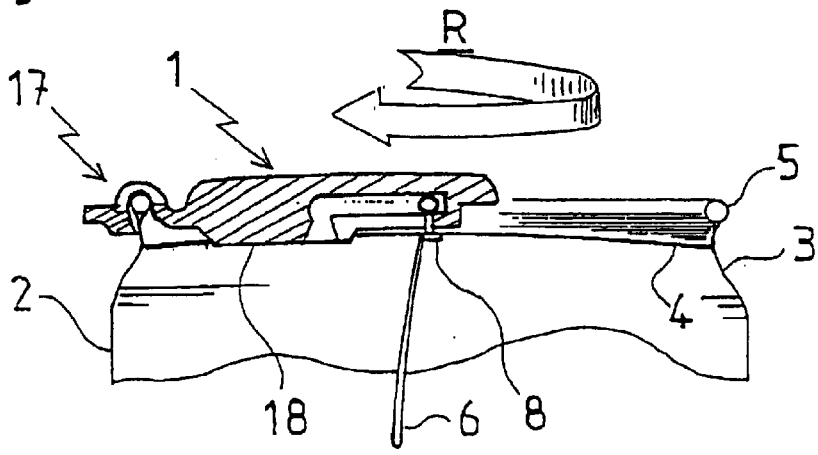

Referring to FIGS. 1*a* and 2*a* and to FIGS. 5 and 10, particularly efficient and preferred alternative of a removable case 1 will now be described implementing the general method according to the invention.

In its general structure, the case 1 corresponding to this second alternative is globally the same as the case 1 of the previous alternative, except regarding the linking part which cooperates with linking joint 9 and more specifically with axis 90 firmly secured to lid 4 by means of a center rivet 8.

According to FIGS. 1*a* and 2*a* showing the ventral portion of case 1 and its section at the linking device, case 1 has a capture shaft 20 positioned perpendicularly to its longitudinal axis, but placed substantially in the middle of case 1 between its two ends 16 and 17 respectively serving as a leading edge 16 for removing the frangible cap 6 and the clipping means 17 on the crimping rim 5, as mentioned for the previous alternative.

According to this preferred embodiment, the shaft 20, allowing axis 90 to be fitted vertically therein when case 1 is brought closer to lid 4, is associated with a translation channel 21 opening onto shaft 20 and extending into a horizontal or inclined plane in the direction of the reinforced edge 16 over such a distance that axis 90, penetrating shaft 20 and following the translation channel 21 through a recess of the case in the direction of the crimping rim in a plane substantially parallel to the plane of the lid and along one of its radials, is in front abutment with the translation channel, when the rear linking means 17 are in position for clipping onto the crimping rim 5. Besides, it will be observed that the front end of the translation channel 21 in this alternative, coincides exactly with the position of the capture shaft 10 of the first alternative, which is clearly shown in FIGS. 1 and 1*a*.

Naturally, the translation channel 21 ensuring radial motion of case 1 after it has been assembled on joint 9 must be such that when it is engaged, axis 90 can no longer escape from said channel and firmly secures case 1 to lid 4, vertically. For that purpose, on each flank 24 vertically delimiting channel 21, a groove 22 is provided laterally widening the bottom 23 of channel 21 over a height equivalent or slightly greater than the diameter of axis 90, providing channel 21 with a T-shaped transversal vertical section.

The depth of grooves 22 is selected to fit the projecting parts 93 and 94 FIGS. (3*a*1–*c*2) of axis 90 snugly with regard to linking part 91 of axis 90. Advantageously, the distance separating both vertical blanks 24 of the translation channel 21 matches the width of said linking part 91.

Finally, it is clear that the grooves 22 open onto the bottom of capture shaft 20, which enables axis 90, after its vertical displacement when case 1 is fitted onto lid 4, to enter into the lateral grooves 22 for allowing a radial translation of the case in the direction of the crimping rim 5 on which it will be clipped subsequently, as will be explained in the following lines with reference to FIGS. 5 to 10.

Obviously, like for the first alternative, the capture shaft 20 may be improved, e.g. by providing a flared tapered entrance up to a longitudinal necking similar to necking 15 of shaft 10, above which the translation channel 21 opens as described before.

The advantage of this embodiment is that it is possible to clip case 1 in the middle of lid 4 before the filling and the crimping on the can 2, in a single vertical fitting operation.

Figure 5:
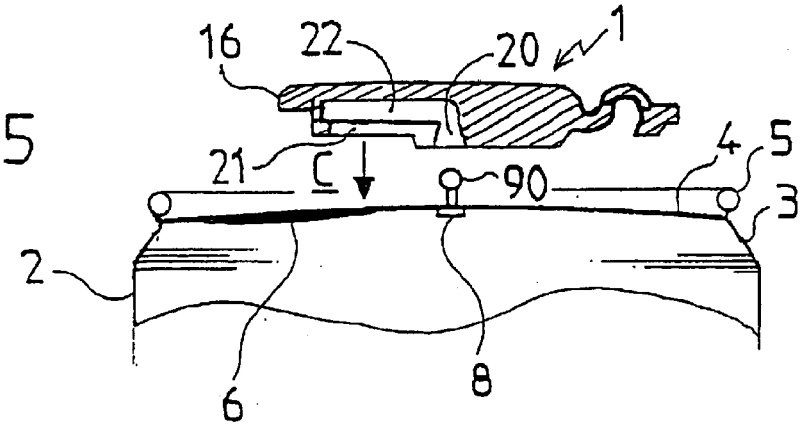
FIGS. 5 to 10 are vertical sectional views schematically illustrating the assembly of a removable case in accordance with the most sophisticated alternative of the method on the linking joint riveted in the middle of the lid of a schematically and partially illustrated can.

Can 2, as partially and schematically illustrated in FIG. 5, is prepared with a lid 4 provided with a frangible obturator 6 (represented with a solid line in all figures), is crimped on can 2 after its filling, which provides a peripheral rim 5 at an extra height in comparison with the side of lid 4. The case 1 shaped according to the second alternative embodiment is shown vertically along arrow C on lid 4 so that the capture shaft 20 is brought to be normal to axis 90 positioned horizontally near the center of lid 4 according to any of the alternatives detailed in FIG. 3.

Figure 6:
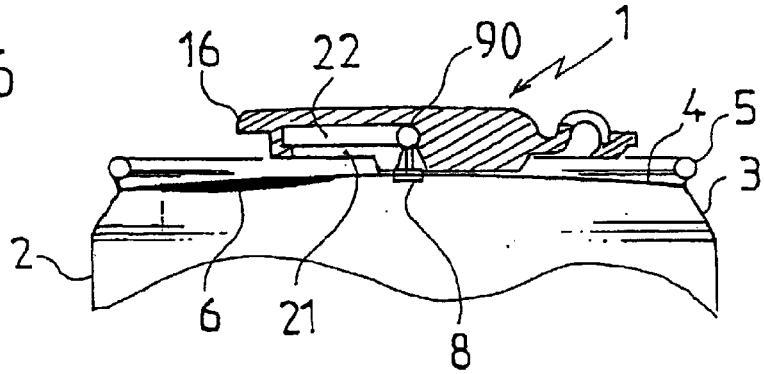

According to this first vertical approach, the lower side 12 and more specifically the bulge 18 of case 1 is resting on lid 4 so that it is entirely comprised within the surface defined by the peripheral rim 5 according to FIG. 6; at this moment, the linking joint 9 is entirely placed into the capture shaft 20 ensuring the required retention of the case on the can 2 which may thus be stacked, stored and dispatched in any already known manner. Besides, it should be noted that case 1 may be assembled on the linking joint 9 prior to crimping lid 4, i.e. before filling, without thereby hindering the subsequent crimping operation.

Figure 7:
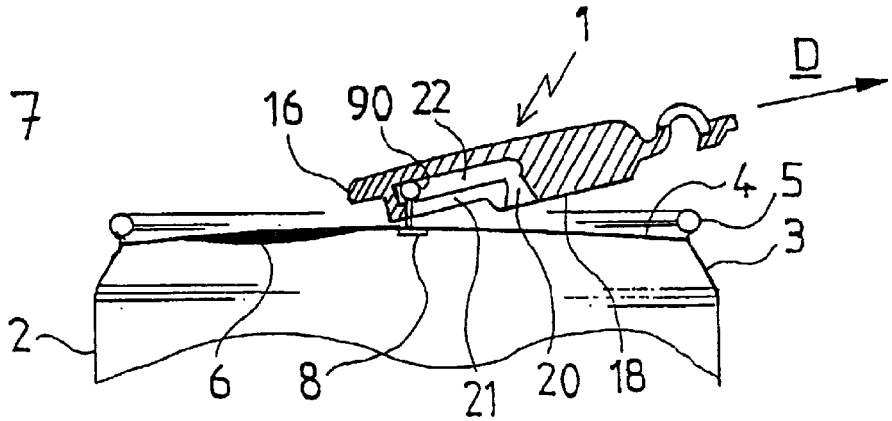
Figure 8:
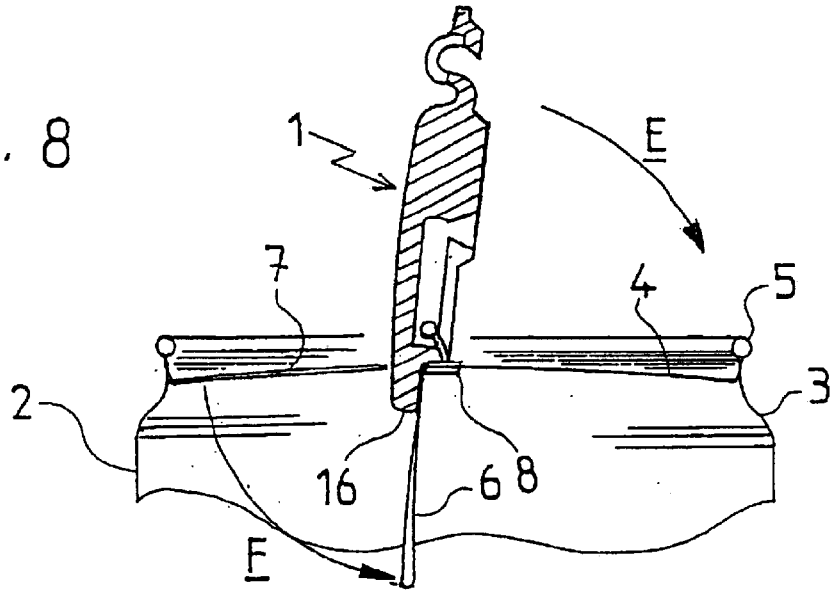
Figure 9:
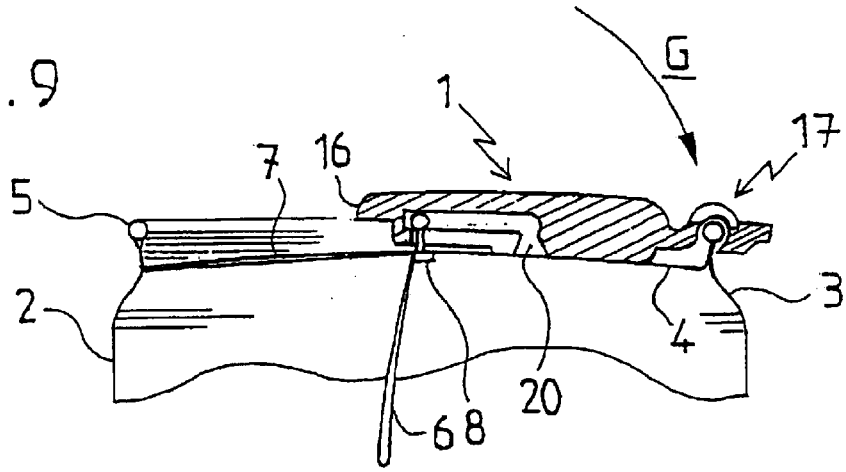

In accordance with FIG. 7, when the liquid contained in can 2 is to be consumed, it is advisable to then remove cap 6 using of course case 1 in accordance with the inventive method. According to FIGS. 7 and 8, in order to open can 2, the operator must grab the end of case 1 closest to rim 5, lift it up slightly to avoid the extra height of said rim 5 and impart translational motion in the direction of arrow D, FIG. 7. This translation D will have the effect that axis 90 is radially displaced along translation channel 21, linking element 91, 92 of axis 90 sliding between two lateral flanks 24 of said translation channel, and the protruding parts 93, 94 of axis 90 following two lateral grooves 22 opening, as seen, onto the bottom of the capture shaft 20 and extending to the front of translation channel 21 where axis 90 abuts and thus firmly secures case 1 to lid 4; the only possible movement is then rotational motion in the direction of arrow E in FIG. 8; when this rotation is extended vertically, the reinforced leading edge 16 of case 1 then contacts the frangible area of the obturator 6 and through the leverage around the bendable linking joint 9 maintained by rivet 8, the obturator 6 is pushed back inside the can in accordance with arrow F in FIG. 8. Of course, the obturator 6 thus pushed back stays in this position and provides the aperture 7 for consuming the liquid. For better clearing of aperture 7, case 1, in accordance with FIG. 9, is then pushed back by reverse rotation along arrow G in FIG. 9 and clipped onto rim 5 by means of the linking joints 17 as described above. It will be noted that this clipping onto the rim 5 is required as otherwise case 1 would stay in an inclined position due to the deformation of the linking part 91, 92 stressed in the movement of FIG. 8 when the obturator is opened. Finally, and then using rim 5 as a guide rail, the user who wishes to temporarily close can 2 for later consumption, will be able to bring, through mere horizontal rotation around rivet 8 according to arrow R of FIG. 10, case 1 normal to aperture 7 into which will fit bulge 18 thus providing a virtually sealed closure which in fact only depends on compression of the case onto aperture 7.

According to a final feature of the invention, it is possible to increase the closing compression; for this purpose, the bottom 23 of the translation channel 21 may be inclined with regard to the flat bottom of bulge 18. The slope of the translation channel results from a slope imparted to bottom 23 from capture shaft 20 to lid center, i.e. towards axis 90. Thus, as case 1 is translated towards peripheral rim 5, as indicated by arrow D in FIG. 7, it is gradually tightened between its supporting side and the upper face of lid 4 so that upon closing (FIG. 10), the pressure of case 1 on aperture 7 is increased significantly, at least when it is clipped onto the rim 5.

It is clearly apparent that all different combinations of the alternative embodiments as described above using for instance the different shapes of linking joints connected to the lid or the case, or other equivalent solutions not described, would not depart from the scope of the invention in as far as the new alternative embodiment would implement the inventive method; in particular, this would be the case if axis 90 were to be replaced by a sphere attached to rivet 8 cooperating with a capture shaft and, if required, a translation channel, e.g. of tubular shape.

What is claimed is:

1. A case for opening and closing a drink can that has a cylindrical body having a rim whereon is crimped a lid with a frangible obturator, the obturator being adapted to open along a line of least resistance to form an aperture, and a link member having a first part that is generally parallel to and spaced from the lid and a second part that attaches the first part to the lid, the case comprising:

a capture shaft adapted to receive the link member and to hold the link member while the case is rotated in a first plane transverse to the lid and in a second plane parallel to the lid;

a rear edge with a clip adapted to removably clip to the crimped rim of the can when said capture shaft receives and holds the link member;

a reinforced leading edge adapted to engage the frangible obturator and create the aperture when the case is rotated in the first plane; and a bottom adapted to close the aperture, wherein rotating the case in the second plane, after rotation in the first plane, reorients the bottom over the aperture, and clipping said clip to the crimped rim closes the aperture, wherein said capture shaft has a longitudinal axis perpendicular to the second plane, a chamber at an end of the longitudinal axis for receiving the link member, wherein an entrance to said chamber has means for holding the link member, wherein said capture shaft has walls that get closer together approaching said chamber and said means for holding the link member comprises a throat with a diameter smaller than a diameter of said chamber.

2. The case of claim 1, wherein said capture shaft has walls parallel to the longitudinal axis and said means for holding the link member comprises flexible tabs that extend across said capture shaft.

3. A case for opening and closing a drink can that has a cylindrical body having a rim whereon is crimped a lid with a frangible obturator, the obturator being adapted to open along a line of least resistance to form an aperture, and a link member having a first part that is generally parallel to and spaced from the lid and a second part that attaches the first part to the lid, the case comprising:

a capture shaft adapted to receive the link member and to hold the link member while the case is rotated in a first plane transverse to the lid and in a second plane parallel to the lid;

a rear edge with a clip adapted to removably clip to the crimped rim of the can when said capture shaft receives and holds the link member;

a reinforced leading edge adapted to engage the frangible obturator and create the aperture when the case is rotated in the first plane; and a bottom adapted to close the aperture, wherein rotating the case in the second plane, after rotation in the first plane, reorients the bottom over the aperture, and clipping said clip to the crimped rim closes the aperture, wherein said capture shaft has a longitudinal portion perpendicular to the second plane and a lateral portion parallel to the second plane.

4. The case of claim 3, wherein said longitudinal portion of said capture shaft has walls that get closer together approaching said lateral portion.

5. A case for opening and closing a drink can that has a cylindrical body having a rim whereon is crimped a lid with a frangible obturator, the obturator being adapted to open along a line of least resistance to form an aperture, and a link member having a first part that is generally parallel to and spaced from the lid and a second part that attaches the first part to the lid, the case comprising:

a capture shaft adapted to receive the link member and to hold the link member while the case is rotated in a first plane transverse to the lid and in a second plane parallel to the lid;

a rear edge with a clip adapted to removably clip to the crimped rim of the can when said capture shaft receives and holds the link member;

a reinforced leading edge adapted to engage the frangible obturator and create the aperture when the case is rotated in the first plane; and a bottom adapted to close the aperture, wherein rotating the case in the second plane, after rotation in the first plane, reorients the bottom over the aperture, and clipping said clip to the crimped rim closes the aperture, wherein said bottom has a bulge that engages the aperture when said clip is clipped to the crimped rim and closes the aperture.

6. A method for opening and closing a drink can having a cylindrical body on which is crimped, through a peripheral crimping rim, a lid provided with a frangible obturator that may be torn apart along a line of least resistance in order to provide a partial aperture by using a case that is removably fitted, through a capture shaft, on a linking joint fixed to a center of the lid, the method comprising the steps of:

pivoting the case in the vertical plane by lifting one end close to the peripheral crimping rim around the linking joint, so that the case acts as a lever and pushes in the frangible obturator by means of another end provided with a reinforced leading edge; and rotating the case in the horizontal plane around the linking joint so as to close the aperture by clipping the one end on the peripheral crimping rim, wherein the case is secured to the lid by vertically pressing the linking joint into a capture shaft of the case, where a leading edge of the case is normal to the frangible obturator and a rear portion of the case is normal to the peripheral crimping rim so as to form the one end for pushing in the frangible obturator.

7. A method for opening and closing a drink can having a cylindrical body on which is crimped, through a peripheral crimping rim, a lid provided with a frangible obturator that may be torn apart along a line of least resistance in order to provide a partial aperture by using a case that is removably fitted, through a capture shaft, on a linking joint fixed to a center of the lid, the method comprising the steps of:

pivoting the case in the vertical plane by lifting one end close to the peripheral crimping rim around the linking joint, so that the case acts as a lever and pushes in the frangible obturator by means of another end provided with a reinforced leading edge; and rotating the case in the horizontal plane around the linking joint so as to close the aperture by clipping the one end on the peripheral crimping rim, wherein the case is secured to the lid by vertically pressing the linking joint into the capture shaft of the case, then moving the case through a radial translation in a horizontal plane in parallel to the lid, wherein a leading edge of the case is normal to the obturator and a rear portion of the case is close to the peripheral crimping rim so as to form the one end for pushing in the frangible obturator.

8. The method according to claim 7, further comprises the step of radially translating the case in the horizontal plane from a pre-opening position so that the case stays completely enclosed inside a space defined by the peripheral crimping rim to a post-opening position, wherein the one end clips onto the peripheral crimping rim so as to be superimposed over the aperture and thus close the aperture.

* * * * *